United States Patent [19]

Dudzik

[11] 4,115,990

[45] Sep. 26, 1978

[54] VOLUMINOUS FILAMENTARY YARN AND METHOD OF MANUFACTURE

[75] Inventor: Chester John Dudzik, Warwick, R.I.

[73] Assignee: Leesona Corporation, Warwick, R.I.

[21] Appl. No.: 815,844

[22] Filed: Jul. 14, 1977

Related U.S. Application Data

[63] Continuation-in-part of Ser. No. 693,738, Jun. 7, 1976, abandoned.

[51] Int. Cl.[2] ..... D02G 1/02

[52] U.S. Cl. ..... 57/140 R; 57/157 S; 57/157 TS; 428/372

[58] Field of Search ..... 57/2, 140 R, 140 J, 57/157 R, 157 S, 157 TS; 428/372, 399

[56] References Cited

U.S. PATENT DOCUMENTS

| | | | |
|---|---|---|---|
| 2,612,679 | 10/1952 | Ladisch | 428/372 |
| 3,117,173 | 1/1964 | Adams | 57/140 J |
| 3,137,991 | 6/1964 | Fairley | 57/157 S |
| 3,618,307 | 11/1971 | Jonkoff | 428/372 X |
| 3,857,233 | 12/1974 | Cardinal et al. | 57/157 R |
| 3,967,441 | 7/1976 | Yasuzuka et al. | 57/157 TS X |

*Primary Examiner*—Charles Gorenstein
*Attorney, Agent, or Firm*—Burnett W. Norton

[57] ABSTRACT

Disclosed herein is a novel voluminous multi-filament stretch of set yarn and a method for manufacturing the yarn. The yarn, formed from continuous filaments, substantially all of which have the same extension to break, has the appearance of spun yarn, i.e., yarn produced from staple length fibers. The continuous filaments constituting the yarn are spun with contaminents present therein. Subsequently, the undrawn or partially drawn yarn is subjected to simultaneous drawing and false twisting which causes generally all of the filaments to break in regions where the contaminents are entrapped while the yarn is contemporaneously processed into textured yarn. The false twisting step includes the usual twisting and untwisting. Since substantially all of the filaments are broken into relatively short lengths, hereinafter sometimes called "staple," during false twisting it is necessary to preclude disintegration of the yarn as it is untwisted. This achieved by any of several techniques. These include providing pre-twist in the supply yarn so that as the yarn undergoes subsequent untwisting, as part of the false twisting, sufficient residual twist exists to bind the staple together and maintain the coherency of the yarn. Another technique includes positively engaging one end of the staple length fiber during untwisting while simultaneously sizing the staple. Consequently, a filamentary stretch yarn is produced which has the appearance of a textured spun yarn. As part of the method the stretch yarn may be post-treated to yield a set yarn with spun yarn characteristics if desired.

6 Claims, 5 Drawing Figures

VOLUMINOUS FILAMENTARY YARN AND METHOD OF MANUFACTURE

CROSS-REFERENCE TO RELATED APPLICATION

This application is a continuation-in-part of co-pending U.S. application Ser. No. 693,738 filed June 7, 1976, now abandoned.

BACKGROUND OF THE INVENTION

The present invention relates to the manufacture of textile yarns and relates, more particularly, to the production of yarns having the appearance of spun yarns but being formed from continuous polymer filaments.

At the outset it will be of use to explain briefly that the term "textured yarns" as employed herein embraces both "torque stretch yarns" and "set yarns". Torque stretch yarns are produced by subjecting yarns comprised of a bundle of filaments to a mechanical treatment to cause the yarns to assume a crimped or coiled configuration so that they have a certain inherent elasticity and have stretch characteristic which distinguish them from untreated yarns. These properties cause them to be highly desirable for certain applications such as stretch-to-fit garments where they have encountered a high degree of consumer acceptance. The most popular or highly used technique for producing torque stretch yarns is known as "false twist texturing". This procedure involves twisting a yarn about its own axis, heat setting the yarn, and then untwisting the yarn. As used herein "stretch yarn(s)" shall mean torque stretch yarn(s).

Closely related to torque stretch yarns are the "set yarns" and, here again, enormous commercial interest has been displayed in these set yarns in recent years. In brief, set yarn is stretch yarn which is created when a torque stretch yarn is relaxed from its fully stretched (straightened) configuration to the point where the crimped configuration is present in the yarn but the so-called pigtails caused by torque from the mechanical treatment of the yarn are not permitted to form. The yarn in this crimped configuration is then treated by heating and cooling so that a substantial amount of the torque is permanently removed from the yarn but the crimped is retained. Set yarns are of commercial importance because of their bulkiness and voluminosity and find wide use, for example, in knitted outerwear applications.

Spun yarn is produced by twisting together a plurality of staple length fibers. Yarns so spun have met with broad customer acceptance based upon appearance, softness of hand and covering power. With the advent of processes for the high rate production of synthetic polymer filaments many attempts have been made to treat these filaments to possess the characteristics of spun yarns. In the absence of some such processing the polymer filaments are smooth, flat and have what has been described as a "clammy" feel. Thus, such filaments have proven generally unacceptable, particularly in apparel applications.

Numerous techniques have evolved in the prior art endeavors to process continuous synthetic filaments so as to possess the characteristics of spun yarns. These include knit-de-knit crimping, stuffer-box crimping, gear crimping, edge crimping, and the aforementioned torque stretch technique. Much effort has been expended in developing yarns comprised of a plurality of the filaments having loose filamentary ends protruding from the yarn to simulate the staple fiber ends and thus the "hand" of a spun yarn and, for convenience, this is referred to herein as "stapilizing". Among these prior art stapilizing processes is a process which employs a rotating brush which rips and unravels the surface of a drawn filamentary yarn. Another process includes forming a yarn of filaments of different elongations, then drawing the yarn so as to break the lower elongation filaments while leaving the other filaments intact. the broken filaments provide loose ends intended to be akin to the loose ends of spun yarn. Other processes include subjecting the continuous filamentary yarn to an abrading action in its passage from a supply spool to a collecting package. Many of those methods have also been applied to the previously-described "textured" yarns. A recently patented process provides for modifying the torsional rigidity of the constituent filaments of the yarn so that at least some of the filaments will shear when false twisted to thus produce a stapilized yarn.

BRIEF SUMMARY OF THE INVENTION

With the foregoing in mind, the present invention admirably provides for the production of a voluminous multi-filament yarn wherein the polymeric filamentary material is formed from a hot melt having contaminents present therein. The contaminents are of a cross-sectional dimension such that they readily pass through the orifices of the spinneret while entrapped in the extruded filaments. Thus, the filamentary material resulting from the extrusion process has the contaminents embedded therein at random, spaced apart locations. Subsequently, and either while the extruded filamentary material is either is an undrawn state or after is has been partially drawn, the filaments, being then combined into a yarn, are processed through a false twist machine which may be the same as that shown and described in the aforementioned U.S. Pat. No. 3,152,436 to produce stretch yarn, the machine being set to simultaneously draw and false twist the filamentary yarn. The drawing results in splitting or breaking of the filaments in the yarn at those points where the contaminents are situated. Since this breaking occurs during the false twisting step, most of the fibrils or whiskers constituting the broken ends of the filaments are twisted into the body of the yarn and thus are not free to extend outwardly from the main body of the yarn and thus jam the false twist spindle. However, downstream of the false twist spindle where subsequent untwisting of the yarn has already occured, the randomly spaced filament ends are freed so that they can extend away from the central body of the yarn, much in the same manner as a staple yarn. Accordingly, as the stretch yarn is wound up it possesses numerous broken filament ends which are randomly spaced along the length of the yarn. While the spacing of the breaks of any given filament in the yarn is random, the dispersion of total breaks along the yarn is such as to give a relatively uniform spacing of the loose ends as a whole along the yarn. Thus, the formed stretch yarn may be post-treated by passing it through a second heating step under a controlled degree of relaxation as a continuous step after stretch processing of the yarn to thereby provide a set yarn with spun characteristics.

It is one object of the present invention to provide a stretch or set yarn from a yarn comprised of a plurality of continuous polymer filaments wherein the stretch or set yarn has characteristics of a spun yarn.

A further object of the present invention is to provide a stretch or set yarn from a yarn comprised of a plurality of thermoplastic filaments, which said filaments have been formed with contaminents entrapped therein, wherein the filaments break when subjected to simultaneous drawing and twisting to thereby yield a stretch or set yarn having a plurality of generally uniformly spaced free staple-like ends projecting from the main yarn.

Still another object of the present invention is to provide a method for manufacturing a yarn from continuous filaments, which said yarn has the appearance and properties of yarn made from natural fibers such as cotton or wool.

Other objects of the invention will, in part, be obvious and will in part appear hereinafter.

DESCRIPTION OF THE PREFERRED EMBODIMENT

Figure 1:
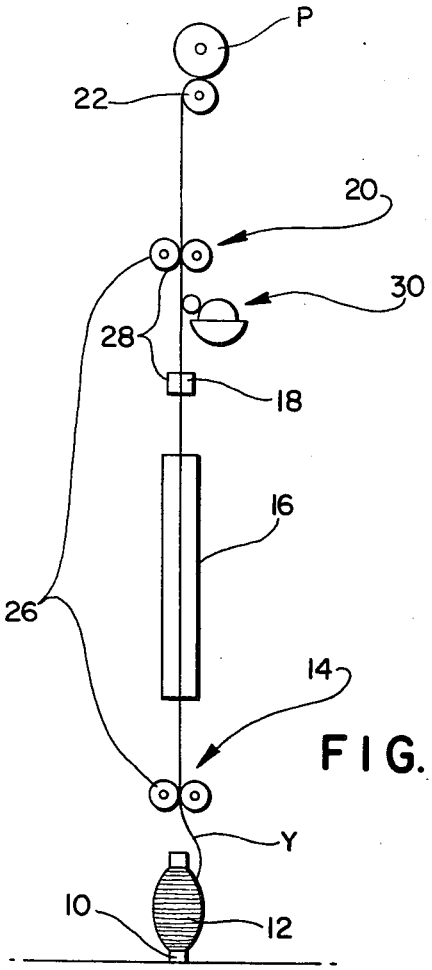
FIG. 1 is a schematic elevational view of one form of the apparatus for carrying out the simultaneous draw-texturing operation of the present invention.

A preferred apparatus for carrying out the method of the present invention illustrated in FIG. 1. This apparatus may be the same as that shown and described in U.S. Pat. No. 3,152,436, the apparatus being set as to have yarn drawing characteristics as will be hereinafter set forth. The apparatus of FIG. 1 may include a plurality of yarn processng positions disposed in side-by-side relationship and driven by common means from a central source of power, not herein illustrated. Since all of the yarn processing positions are identical, it will suffice to describe just one position herein. Thus, each position includes a suply package holder 10 which serves as a mount for a supply package 12 of continuous filamentary thermoplastic material which may be in an undrawn or partially drawn state.

As has already been mentioned, in accordance with one embodiment of the invention, yarn Y on package 12 may have a level of twist inserted therein which will be sufficient to maintain the coherency of the yarn after the broken filaments are untwisted as part of the false twisting process. Such twist in the supply yarn Y may be in the order of 3–5 T.P.I. This twist may be in the same sense as that inserted by the false twist spindle (yet to be described) or may be in the opposite sense. This twist may be inserted in the supply yarn Y as a separate step prior to positioning the supply package 12 on the machine or, in the alternative, twist can be inserted in the supply yarn Y prior to the yarn entering feed rolls 14 as by, for example, rotating package 12, in situ on the texturing machine by means of a belt 13 driving supply package holder 10 on which the package 12 is secured positioned for rotation therewith. Belt 13 may be driven by any suitable means such as an electric motor.

The outer yarn and Y of package 12 is threaded through a first pair of feed rolls 14, over a conventional contact heater 16, through a false twist spindle 13, a second pair of feed rolls 20, with the yarn being ultimately wound up to the package P which is rotated by surface contact with a driven package driving roll 22. Again, since the just-described apparatus may be the same as the apparatus of U.S. Pat. No. 3,152,436, further particulars of the over-all characteristics need not be provided herein, reference being made to the cited patent for further details of the apparatus.

Feed rolls 14 and 20 are driven at preselected speeds to impart a predetermined draw or elongation in yarn Y in the zone 26 which will be referred to hereinafter as the draw-twist zone. In the draw-twist zone 26 where yarn Y is subjected to the predetermined elongation as just mentioned, the yarn is drawn down to its desired denier while simultaneously being subjected to the false twisting action of spindle 18. The elongation in draw-twist zone 26 is set to a valve such that most of the filaments constituting yarn Y will fracture or split at the loci therealong where contaminents are entrapped therein. In the region of draw-twist zone 26 below false twist spindle 18, the yarn Y is twisted as the constituent filaments of the yarn Y break. Thus, most of the broken filament ends are wrapped into the adjacent filament and, consequently, do not present any obstacle to passage of the yarn around the twist trapping pin of false twist spindle 18. Twist migration in yarn Y is precluded from running back to supply package Y by feed rolls 14 which act as a twist restrictor. Accordingly, a smooth and uninterrupted flow of yarn Y from supply package 12 to take up package P is afforded throughout the process.

It will be rather apparent that unless steps are taken to preclude disintegration of the yarn downstream of false twist spindle 18, the broken filaments, which are being rotated at high speeds, i.e. 300,000 RPM and higher, will fly around and the yarn will break up. Accordingly, and which has already been mentioned, the supply yarn Y on package P can be pre-twisted. Consequently, as untwisting occurs in the zone 28 downstream of false twist spindle 18, the yarn has residual twist therein which, in fact, is that twist which orginally existed in the supply yarn at the time of its entry into draw-twist zone 26. The residual twist acts to keep the staple, i.e. the broken filaments interlocked with each other and, thus, maintain coherency of the textured yarn strand.

Another approach to maintaining yarn strand coherency includes positioning feed rolls 20 a distance from false twist spindle 18 less than the length of the staple or broken fibers. A conventional sizing unit 30 is disproved in zone 28 and acts to apply a size to the yarn as it leaves false twist spindle 18 and is untwisted. By virture of the fact that the broken filaments are positively engaged between the yarn engaging element within false twist spindle 18 and feed rolls 20 as the size is applied the broken filaments cannot fly off during untwisting and as the size is applied. The size preserves the integrity of the strand during winding up of the strand into package P.

Figure 2:
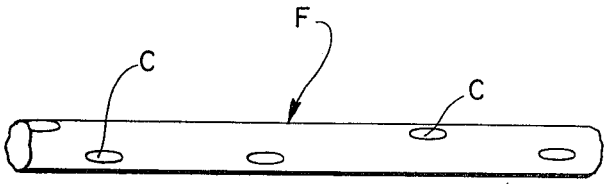
FIG. 2 is an illustration on a greatly increased scale of a length of an individual filament extruded with contaminents entrapped therein.
Figure 3:
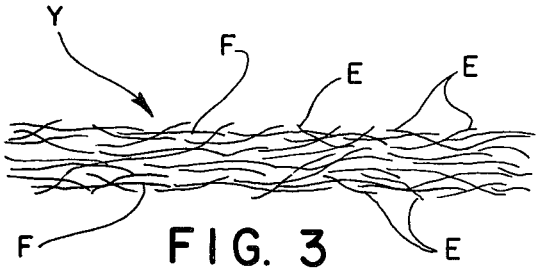
FIG. 3 is an illustration of a textured yarn processed in accordance with the present invention, the filamentary spacing being exaggerated to shown the random breaking of the filaments through the yarn.
Figure 5:
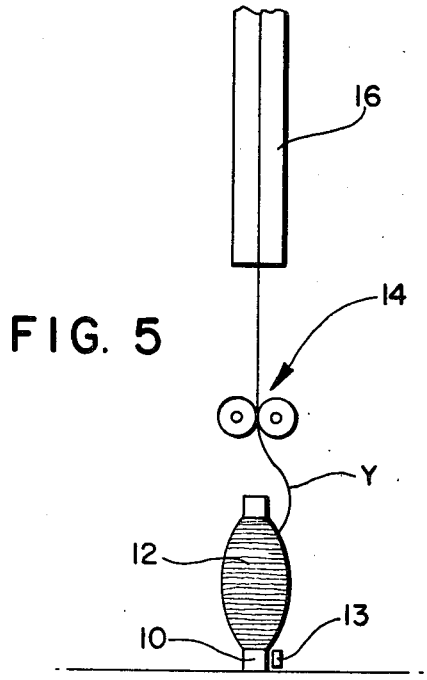
FIG. 5 is a detail view of a supply package mounted for rotating by a belt.

With reference to FIG. 2, a constituent filament F of yarn Y is illustrated. The filament is constituted as an elongated fiber having randomly interspersed contaminent C therein. By "contaminent" is meant some ingredient which is foreign to the chemical make-up of the plastic filament F and which will not become compatible with or mix with the hot melt from which the filament is formed. In a typical example where the hot melt is filament forming polyester the contaminents may include polymer char, gel, titanium dioxide or other pigment agglomerates, catalyst or stabilizer residues, cellulose fibers, fiberglass, thermoplastics such as polyolefins, and other miscellaneous substances. It will be appreciated that the contaminents create weak or fracture points in the filaments where the filaments will rather readily split or break as the bundle of filaments making up yarn Y are subjected to the drawing and twisting manipulative action in draw-twist zone 26. As the yarn Y emerges from false twist spindle 18 and is subjected to the untwisting rotation of the false twist spindle, the broken filaments F twisted upon themselves as they pass through false twist spindle 18, are released so that they assume a configuration as depicted in FIG. 3 where fibrils or free ends E of the various filaments project away from the main body of the yarn Y, thus, presenting characteristics of spun yarn. Although the breaks or interruptions in any given filament will be randomly spaced along the length of the filament, nevertheless, in view of the fact that the yarn is constituted of a plurality of such filaments, the yarn will present a rather generally equal and balanced number of free filament ends per each unit length thereof. The yarn of FIG. 3 possesses residual twist holding the filaments together, this residual twist being that twist present in the supply yarn Y.

Figure 4:
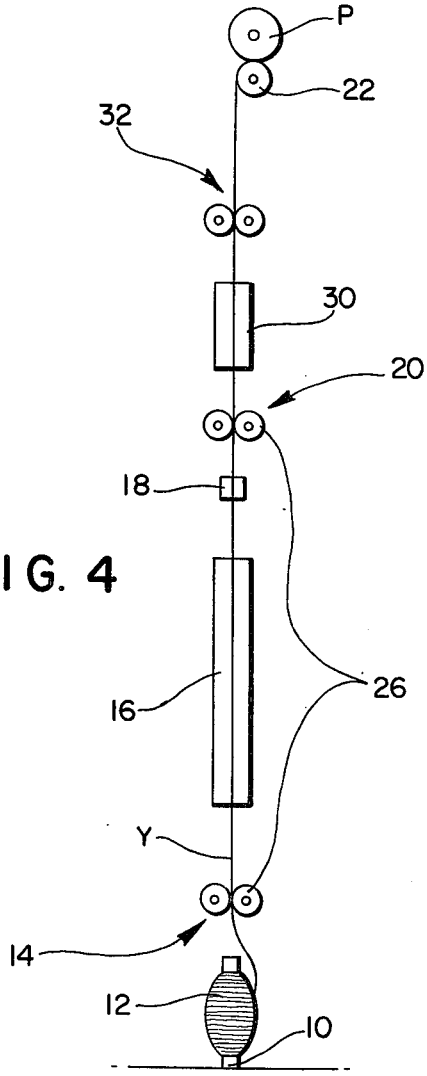
FIG. 4 is a modified form of the apparatus of FIG. 1, which said modified apparatus is suitable for the production of set yarn in accordance with the present invention.

In FIG. 4 a modified form of the apparatus is shown. As illustrated in this view, a second heater 30 is interposed between take-up package drive roll 22 and feed rolls 20. Also, a further set of feed rolls 32 is positioned between package drive roll 22 and heater 30. Thus, feed rolls 20 and 32 are driven at preselected rates in combination with the heater post-treating the yarn. This post-treating includes the step of passing the stretch yarn through the heated zone defined by heater 30 while controlling the degree of relaxation of the yarn therein by the relative rates at which feed rolls 20 and 32 are driven. Consequently, the resulting yarn taken up on package P is set yarn which has been set in a configuration defined as the yarn passes through heating zone 30. In the process of FIG. 4 the starting supply yarn is provided with twist sufficient to maintain the coherency of the yarn after the filaments have been broken and during untwisting of the yarn downstream of spindle 18. Here, as in the embodiment of FIG. 1, the initial twist possessed by yarn Y may be in the order of 3–5 T.P.I. and may be in either and S or Z sense irrespective of the direction of movement of false twist spindle 18.

While particular embodiments of the present invention have been herein illustrated and described, it is not intended to limit the invention to such a disclosure, but changes and modifications may be made therein and thereto within the scope of the following claims.

What is claimed is:

1. A method of manufacturing yarn comprising the steps of, providing a source of unprocessed supply yarn constituted of a bundle of extruded thermoplastic filaments wherein all of said filaments are either undrawn or all are partially drawn to the same degree with at least a substantial portion of the filaments having contaminant particles embedded therein and randomly spaced along the length thereof and with said bundle of filaments being twisted to a level to preclude disintegration of said filaments during subsequent processing, continuously withdrawing the yarn from said source at a preselected linear speed, passing said yarn through a draw-twist zone under a predetermined tension to simultaneously draw said yarn to a predetermined cross-sectional dimension while effecting breakage of substantially all of the filaments at the loci of the contaminant particles therein to provide free ends of said filaments, said yarn when in said draw-twist zone being subjected to stretching in the order of 40-95 percent of the ultimate elongation of the yarn, concurrently heating and cooling said yarn in said draw-twist zone while twisting the yarn in said heated zone and untwisting the yarn to thereby false twist the yarn, a substantial portion of the free ends of the filaments being twisted into said bundle of filaments constituting the yarn as the yarn is twisted and at least a portion of said free ends being released to extend away from said bundle of filaments when said yarn is untwisted with unbroken filaments randomly situated along the length of said yarn with portions of said unbroken filaments being on the surface of said yarn and portions being interiorly of said yarn, and finally collecting the processed yarn after it is untwisted.

2. The method as set forth in claim 1 including the step of passing said yarn through a second heated zone under a controlled degree of relaxation after said yarn in untwisted and prior to said yarn being collected to thereby set said yarn in said relaxed configuration.

3. The method as set forth in claim 1 wherein said unprocessed yarn is a filament forming polyester and said contaminent is a material selected from a group consisting of polymer char, gel, titanium dioxide, stabilizer residues, cellulose fibers, fiberglass, or thermoplastics.

4. The method as set forth in claim 1 including the step of sizing said yarn as the yarn is untwisted and while said broken filaments are positively gripped between an upstream and a downstream location.

5. A yarn produced in accordance with the method of claim 1.

6. A yarn produced in accordance with the method of claim 2.

* * * * *